US007587909B2

(12) United States Patent
Yoon et al.

(10) Patent No.: US 7,587,909 B2
(45) Date of Patent: Sep. 15, 2009

(54) MULTI TYPE AIR-CONDITIONER AND CONTROL METHOD THEREOF

(75) Inventors: Seok-Ho Yoon, Gyeonggi-Do (KR); Si-Kyong Sung, Seoul (KR); Do-Yong Ha, Seoul (KR); Jin-Ha Choi, Gyeonggi-Do (KR); Ho-Jong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 364 days.

(21) Appl. No.: 11/354,093

(22) Filed: Feb. 15, 2006

(65) Prior Publication Data

US 2006/0179868 A1 Aug. 17, 2006

(30) Foreign Application Priority Data

Feb. 17, 2005 (KR) ..... 10-2005-0013307

(51) Int. Cl.
*F25B 39/04* (2006.01)

(52) U.S. Cl. ..... 62/324.6; 62/324.1

(58) Field of Classification Search ..... 62/324.6
See application file for complete search history.

(56) References Cited

U.S. PATENT DOCUMENTS 2,135,742 A * 11/1938 Brace et al. ..... 62/95
2,264,848 A * 12/1941 Kahl ..... 165/43
3,132,492 A * 5/1964 McGrath ..... 62/324.1
4,240,269 A * 12/1980 Bussjager ..... 62/324.6
4,760,707 A 8/1988 Dennis et al.
4,987,747 A * 1/1991 Nakamura et al. ..... 62/160
5,063,752 A * 11/1991 Nakamura et al. ..... 62/225
5,279,131 A 1/1994 Urushihata et al.
6,755,038 B2 6/2004 Hwang
6,772,600 B2 8/2004 Hwang (Continued)

FOREIGN PATENT DOCUMENTS

CN 1469084 1/2004

(Continued)

OTHER PUBLICATIONS

U.S. Appl. No. 11/349,981 to Yoon et al., filed Feb. 9, 2006.

(Continued)

*Primary Examiner*—Frantz F Jules
*Assistant Examiner*—Alexis K Cox
(74) *Attorney, Agent, or Firm*—Ked & Associates LLP

(57) ABSTRACT

A multi type air conditioner comprises: an outdoor unit including an outdoor heat exchanger heat-exchanged with the outdoor air, a compressor compressing a refrigerant, and a first four-way valve and a second four-way valve switching a refrigerant flow path; indoor units performing at least one of cooling operation and heating operation; and a distributor including a low pressure pipe connected between the first four-way valve and each of the indoor units, a high pressure pipe connected between the second four-way valve and each of the indoor units, and a refrigerant pipe connected between the outer heat-exchanger and each of the indoor units. Accordingly, flow resistance of a refrigerant is reduced in heating operation, thereby improving heating performance and heating efficiency, and the amount of refrigerant accumulated within a high pressure pipe is minimized in cooling operation, thereby improving cooling performance and cooling efficiency.

5 Claims, 6 Drawing Sheets

U.S. PATENT DOCUMENTS

| | | | | |
|---|---|---|---|---|
| 2003/0221436 | A1* | 12/2003 | Xu | 62/260 |
| 2003/0233836 | A1* | 12/2003 | Tanimoto et al. | 62/175 |
| 2004/0083751 | A1* | 5/2004 | Nakatani et al. | 62/324.1 |
| 2004/0134205 | A1 | 7/2004 | Park et al. | |
| 2004/0182101 | A1 | 9/2004 | Shimoda et al. | |
| 2005/0115271 | A1 | 6/2005 | Takegami et al. | |
| 2005/0150243 | A1 | 7/2005 | Matsuoka et al. | |

FOREIGN PATENT DOCUMENTS

| | | |
|---|---|---|
| CN | 1517632 | 8/2004 |
| EP | 1498668 | 1/2005 |
| EP | 1635129 | 3/2006 |
| GB | 2248494 | 4/1992 |
| WO | 2004/008048 | 1/2004 |

OTHER PUBLICATIONS

U.S. Appl. No. 11/194,440 to Yoon et al., filed Aug. 2, 2005.
English language translation of CN 1469084.

* cited by examiner

MULTI TYPE AIR-CONDITIONER AND CONTROL METHOD THEREOF

BACKGROUND OF THE INVENTION

1. Field of the Invention

The present invention relates to a multi type air conditioner and its control method, and more particularly, to a multi type air conditioner and its control method capable of improving heating operation efficiency by minimizing the flow resistance of a refrigerant when all operating indoor units are in a heating operation mode and of improving cooling efficiency by preventing an accumulation of a liquefied refrigerant in a high pressure pipe when all operating indoor units are in a cooling operation mode.

2. Description of the Conventional Art

In general, a multi type air conditioner includes several indoor units such that some perform heating and others perform cooling.

FIG. 1 is a construction view of the multi type air conditioner in accordance with the conventional art.

The multi type air conditioner in accordance with the conventional art includes an outdoor unit 102 heat-exchanged with the outdoor air, a plurality of indoor units 104 heat-exchanged with the indoor air and performing cooling and heating operation, and a distributor 106 disposed between the outdoor unit 102 and the indoor units 104 and properly distributing a refrigerant of the outdoor unit 102 to the indoor units 104.

The outdoor unit 102 includes a plurality of outdoor heat exchangers 108 heat-exchanged with the outdoor air, a four-way valve 110 switching the flow of a refrigerant in a forward or reverse direction, an outdoor expansion valve 122 disposed at a refrigerant pipe 120 connected between the outdoor heat exchanger 108 and the indoor unit 104, for changing a refrigerant to a low-temperature low-pressure refrigerant, a plurality of compressors 130 compressing the refrigerant to a high-temperature high-pressure refrigerant, and an accumulator 132 connected to an intake side of the compressors 130, dividing a refrigerant into a gas and a liquid and supplying a gaseous refrigerant to the compressor.

A blower fan 134 for blowing the outdoor air for heat exchange to the outdoor heat exchangers 108 is installed at one side of the outdoor heat exchanger 108, and a bypass flow path 126 provided with the check valve 124 is installed at the refrigerant pipe 120 where the outdoor expansion valve 122 is installed.

The indoor unit 104 includes a plurality of indoor heat exchangers 112 heat-exchanged with the indoor air, and an indoor expansion valve 114 installed at one side of the indoor heat exchanger 112.

The distributor 106 includes a high pressure pipe 140 connected to a discharge side of the compressors 130, first distribution pipes 144 diverged from the high pressure pipe to each indoor unit 104, a low pressure pipe 142 connected to an intake side of the compressors 130, second distribution pipes 146 diverged from the low pressure pipe 142 to the plurality of indoor units 104, first two-way valves 150 respectively installed at the first distribution pipes 144 and opening and closing the first distribution pipes 144, and second two-way valves 152 respectively installed at the second distribution pipes 146 and opening and closing the second distribution pipes 146.

Third distribution pipes 148 are diverged from the refrigerant pipe 120 connected to the outdoor heat exchanger 108 and are connected to the indoor heat exchanger 112.

Here, a large-diameter pipe having the biggest diameter is used as the low pressure pipe 142, and a middle-diameter pipe having a diameter smaller than that of the low pressure pipe 142 is used as the high pressure pipe 140, and a small-diameter pipe having a diameter smaller than that of the high pressure pipe 140 is used as the refrigerant pipe 120.

The operation of the air conditioner constructed in the aforementioned manner in accordance with the conventional art will now be described. As shown in FIG. 1, if all of operating indoor units 104 are operated for heating, the four-way valve 110 is controlled to connect the outdoor heat exchanger 108 with the intake side of the compressors 130, the first two-way valves 150 are all turned ON to open the high pressure pipe 140, and the second two-way valves are turned OFF to close the low pressure pipe 142.

In such a state, when the compressors 130 are operated, a refrigerant compressed by the compressors 130 flows along the high pressure pipe 140 having a middle diameter and is distributed to each indoor unit 104 by the first distribution pipe 144. The refrigerant supplied to each of the indoor units 104 is heat-exchanged with the indoor air to perform heating while passing through the indoor heat exchanger 112, and the refrigerant discharged from the indoor heat exchanger 112 flows along the refrigerant pipe 120 and is decompressed and expanded while passing through the outdoor expansion valve 122. Then, the refrigerant is introduced into the outdoor heat exchanger 108, is heat-exchanged with the outdoor air therein, and then is introduced to the compressors 130 via the four-way valve 110.

However, the air conditioner in accordance with the conventional art has the following problems.

If all of the operating indoor units are operated for heating, flow resistance occurs while a refrigerant passes through the high pressure pipe having a middle diameter because the refrigerant compressed in the compressors are supplied to each indoor unit through the high pressure pipe, which causes deterioration of the heating capacity and heating efficiency.

As shown in FIG. 2, if all of the operating indoor units 104 are operated for cooling, the first two-way valves 150 are turned OFF, and the second two-way valves 152 are turned ON. If the compressors 130 are driven in such a state, a refrigerant compressed by the compressors 130 are condensed while passing through the outdoor heat exchanger 108 and is supplied to each indoor unit 104 through the refrigerant pipe 120 and each third distribution pipe 148. The refrigerant supplied to the indoor unit 104 is decompressed and expanded while passing through the indoor expansion valve 114, and then, the refrigerant is supplied to the indoor heat exchanger 112. Having passed through the indoor heat exchanger 112, the refrigerant is heat-exchanged with the indoor air and performs cooling. The refrigerant having passed through the indoor heat exchanger 112 is introduced to the compressors 130 through the second distribution pipe 146 and the low pressure pipe 142 which are opened as the second two-way valves 152 are turned ON.

As mentioned above, because the first two-way valves 150 is turned OFF and thus, the high pressure pipe 140 is closed when all of the operating indoor unit 104 are operated for cooling, a portion of a high-temperature high-pressure refrigerant compressed in the compressors 130 fills in the high pressure pipe 140. Accordingly, condensation of the refrigerant occurs within the high pressure pipe 140, and thus a liquefied refrigerant is accumulated in the high pressure pipe 140, which causes a shortage of a circulating refrigerant and deterioration of cooling performance.

Particularly, if the high pressure pipe 140 becomes long because of a long distance between the outdoor unit 104 and the distributor 106, quite a large amount of liquefied refrigerant is accumulated within the high pressure pipe 140, which worsens the shortage of a circulating refrigerant and causes damage to the compressors 130 for lack of oil.

BRIEF DESCRIPTION OF THE INVENTION

Therefore, an object of the present invention is to provide a multi type air conditioner capable of improving heating performance and heating efficiency by reducing flow resistance of a refrigerant in heating operation and of improving cooling performance and cooling efficiency by minimizing the amount of refrigerant accumulated within a high pressure pipe in cooling operation.

To achieve these and other advantages and in accordance with the purpose of the present invention, as embodied and broadly described herein, there is provided a multi type air conditioner comprising: an outdoor unit including an outdoor heat exchanger heat-exchanging with the outdoor air, a plurality of compressors compressing a refrigerant, and a first four-way valve and a second four-way valve switching a refrigerant flow path; indoor units performing at least one of cooling operation and heating operation; and a distributor including a low pressure pipe connected between the first four-way valve and each of the indoor units, a high pressure pipe connected between the second four-way valve and each of the indoor units, and a refrigerant pipe connected between the outer heat-exchanger and each of the indoor units.

The first four-way valve is connected to a discharge side and an intake side of the compressors, a low pressure pipe and an outdoor heat exchanger, and the second four-way valve is connected to the discharge side and the intake side of the compressors and the high pressure pipe, so as to selectively switch the refrigerant flow path.

A control unit controlling the first four-way valve and the second four-way valve according to an operation mode of the indoor units and turning ON/OFF the first two-way valve and the second two-way valve, is further included.

To achieve these and other advantages and in accordance with the purpose of the present invention, as embodied and broadly described herein, there is provided a control method of a multi type air conditioner comprising: determining an operation mode of each of indoor unit according to a signal applied from the indoor units; and controlling a first four-way valve and a second four-way valve when the operation mode of each of the indoor units is determined, and also turning ON/OFF first two-way valves and second two-way valves.

When all of the indoor units are operated for heating, the first four-way valve and the second four-way valve are controlled such that a refrigerant discharged from a compressors are supplied to the indoor units through a low pressure pipe and a high pressure pipe.

When all of the indoor units are operated for cooling, the first four-way valve and the second four-way valve are controlled such that a refrigerant discharged from the indoor units is introduced to the compressors through the low pressure pipe and the high pressure pipe.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

A plurality of embodiments of a multi type air conditioner in accordance with the present invention will now be described, and the most preferred embodiment will now be described.

Figure 1:
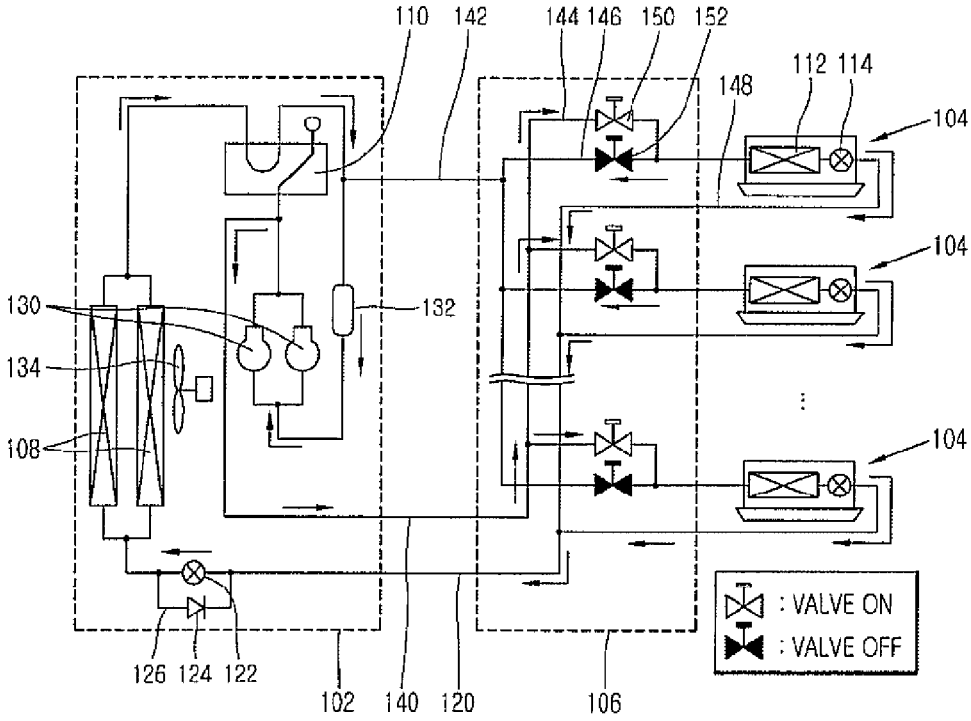
FIG. 1 CONVENTIONAL ART
FIG. 1 is a construction view of a multi type air conditioner in accordance with the conventional art.
Figure 2:
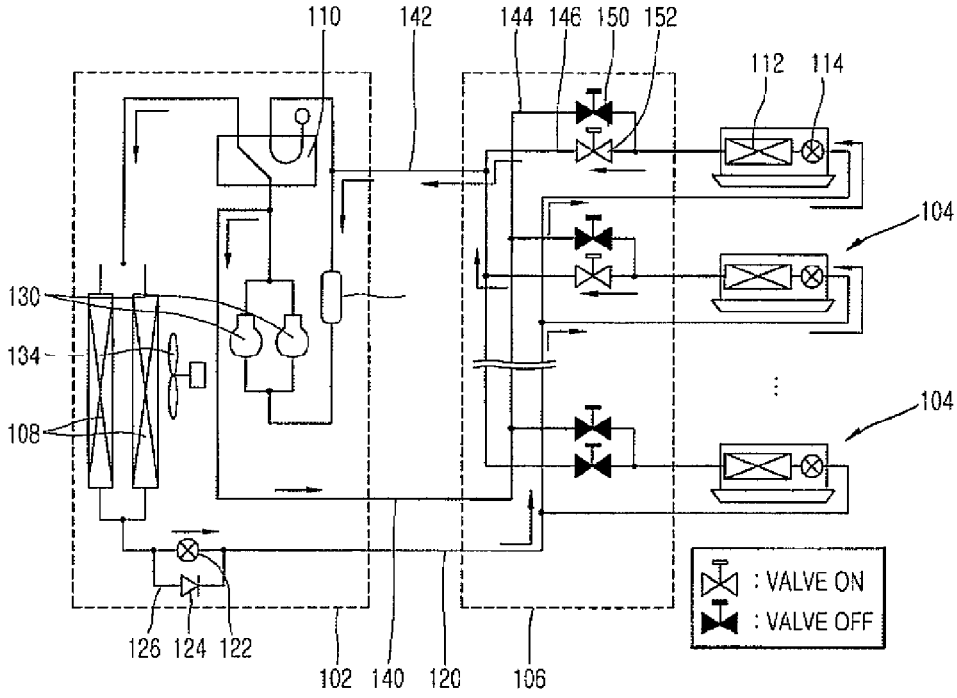
FIG. 2 CONVENTIONAL ART
FIG. 2 is a construction view that illustrates an operational state of the multi type air conditioner in accordance with the conventional art.
Figure 3:
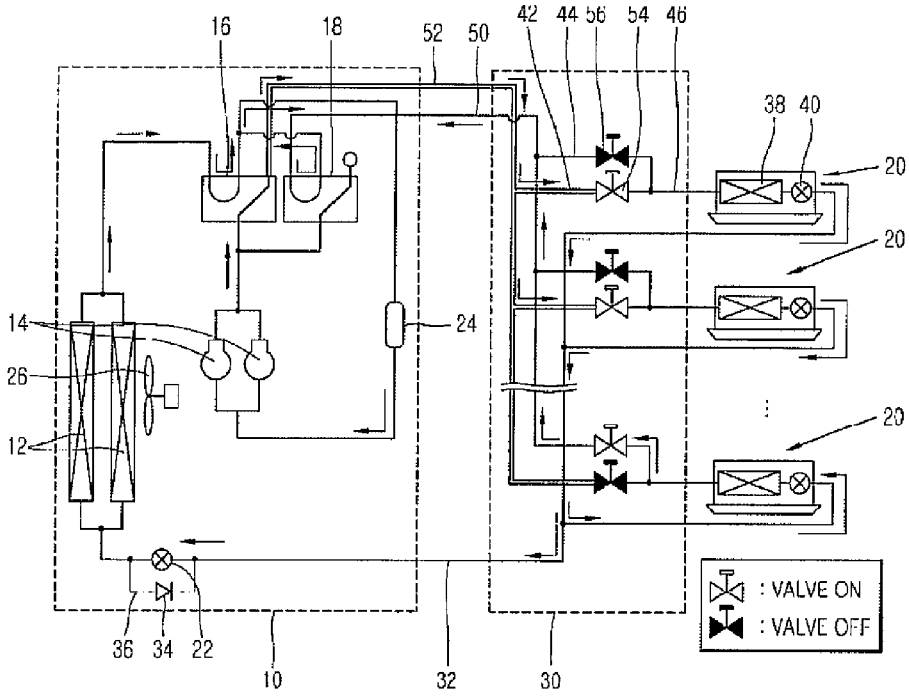
FIG. 3 is a construction view of a multi type air conditioner in accordance with the present invention.

FIG. 3 is a construction view of a multi type air conditioner in accordance with the present invention.

The multi type air conditioner in accordance with the present invention includes an outdoor unit 10 disposed outdoors and heat-exchanged with the outdoor air, a plurality of indoor units 20 disposed indoors and performing cooling and heating for a room, and a distributor 30 installed between the outdoor unit 10 and the indoor units 20 and distributing a refrigerant discharged from the outdoor unit 10 to each of the indoor units 20.

The outdoor unit 10 includes a plurality of outdoor heat exchangers 12 heat- exchanged with the outdoor air, a plurality of compressors 14 compressing a refrigerant, a first four-way valve 16 and a second four-way valve 18 connected to a discharge side and an intake side of the compressors 14 and the outdoor heat exchanger 12 and switching the flow of a refrigerant, an outdoor expansion valve 22 disposed at a refrigerant pipe 32 connected between the outdoor heat exchanger 12 and the indoor units 20 and decompressing and expanding a refrigerant, and an accumulator 24 connected to intake sides of the compressors 14, dividing a refrigerant into a gas and a liquid and supplying a gaseous refrigerant to the compressors 14.

A blower fan 26 for blowing the outdoor air for heat exchange to the outdoor heat exchanger 12 is installed at one side of the outdoor heat exchangers 12, and a bypass flow path 36 provided with a check valve 34 is installed at the refrigerant pipe 32 where the outdoor expansion valve 22 is installed.

The indoor units each include a heat exchanger 38 heat-exchanging with the indoor air, and an indoor expansion valve 40 installed at one side of the outdoor heat exchanger 38.

The distributor 30 includes a low pressure pipe 50 connected to the first four-way valve 16 and connected to each of the indoor units by first distribution pipes 42, a high pressure pipe 52 connected to the second four-way valve 18 and connected to each of the indoor units 20 by second distribution pipes 44, and a refrigerant pipe 32 connected to the outdoor heat exchanger 12 and connected to each of the indoor units 20 by third distribution pipes 46.

The low pressure pipe 50 is a pipe having a large diameter, the high pressure pipe 52 is a pipe having a diameter smaller than that of the low pressure pipe 50, and the refrigerant pipe 32 is a pipe having a diameter smaller than that of the high pressure pipe 52.

Here, as an example of the diameters of the pipes, if the diameter of the low pressure pipe 50 is ⅝ inches, preferably, the high pressure pipe 52 is formed to have a diameter of about ⅞~1 inch, and the refrigerant pip 32 is formed to have a diameter of about ½ inch.

A first two-way valve 54 is installed at each of the first distribution pipes 42 so as to open and close the first distribution pipes 42, and a second two way valve 56 is installed at each of the second distribution pipes 44 so as to open and close the second distribution pipes 44.

The first four-way valve 16 switches a refrigerant flow path by being respectively connected to the outdoor heat exchanger 12, the discharge side and the intake side of the compressors 14 and the low pressure pipe 50, and the second four-way valve 18 switches a refrigerant flow path by being respectively connected to the discharge side and the intake side of the compressors 14 and the high pressure pipe 52.

Figure 4:
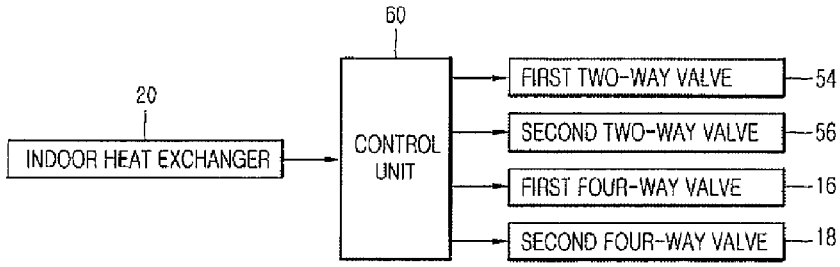
FIG. 4 is a block diagram that illustrates a control unit of the multi type air conditioner in accordance with the present invention.

As shown in FIG. 4, the air conditioner further includes a control unit 60 respectively controlling the first four-way valve 16, the second four-way valve 18, the first two-way valve 54 and the second two-way valve 56 according to an operation mode.

Namely, the control unit 60 switches a refrigerant flow path upon applying an electric signal to the first four-way valve 16 and the second four-way valve 18 according to an operation mode of the indoor unit 20, and turns ON/OFF the first valve 54 and the second valve 56 to thereby open and close the first distribution pipes 42 and the second distribution pipes 44.

The operation of the air conditioner constructed in the aforementioned manner in accordance with the present invention will now be described.

First, if the number of indoor units 20 performing heating operation is greater than the number of indoor units performing cooling operation, as shown in FIG. 3, the control unit 60 turns ON the first two-way valve 54 installed at the first distribution pipe 42 connected to the indoor unit 20 performing the heating operation and turns OFF the second two-way valve 56 according to a signal applied from the indoor units 20, thereby opening the low pressure pipe 50 and closing the high pressure pipe 44. Also, the control unit 60 turns OFF the first two-way valve 54 installed at the first distribution pipe 44 connected to the indoor unit 20 performing the cooling operation and turns ON the second two-way valve 56.

The control unit 60 controls the first four-way valve 16 to connect the discharge side of the compressors 14 with the low pressure pipe 50 and to connect the intake side of the compressors 14 with the outdoor heat exchanger 12. Also, the control unit 60 controls the second two-way valve 18 to connect the high pressure pipe 52 with the intake side of the compressors 14.

If the compressors 14 is driven in such a state, a refrigerant compressed in the compressors 14 is supplied to the indoor unit 20, which performs heating operation, through the low pressure pipe 50, and is heat-exchanged with the indoor air to perform the heating operation while passing through the indoor heat exchanger 38. A portion of a refrigerant discharged from the indoor heat exchanger 38 is introduced to the indoor unit 20 performing cooling, and the remaining refrigerant flows to the outdoor unit 10 through the refrigerant pipe 32. The refrigerant flowing to the outdoor unit 10 is decompressed and expanded while passing through the outdoor expansion valve 22, and is heat-exchanged with the outdoor air while passing through the outdoor heat exchanger 12. Then, the refrigerant is supplied to the compressors 14 via the first four-way valve 16.

Also, the refrigerant introduced to the indoor unit 20 performing the cooling operation is decompressed and expanded while passing through the indoor expansion valve 40, and then is supplied to the indoor heat exchanger 38 to perform the cooling operation by being heat-exchanged with the indoor air. The refrigerant discharged from the indoor heat exchanger 38 flows along the high pressure pipe 52 and is received in the compressors 14 via the second four-way valve 18.

Figure 5:
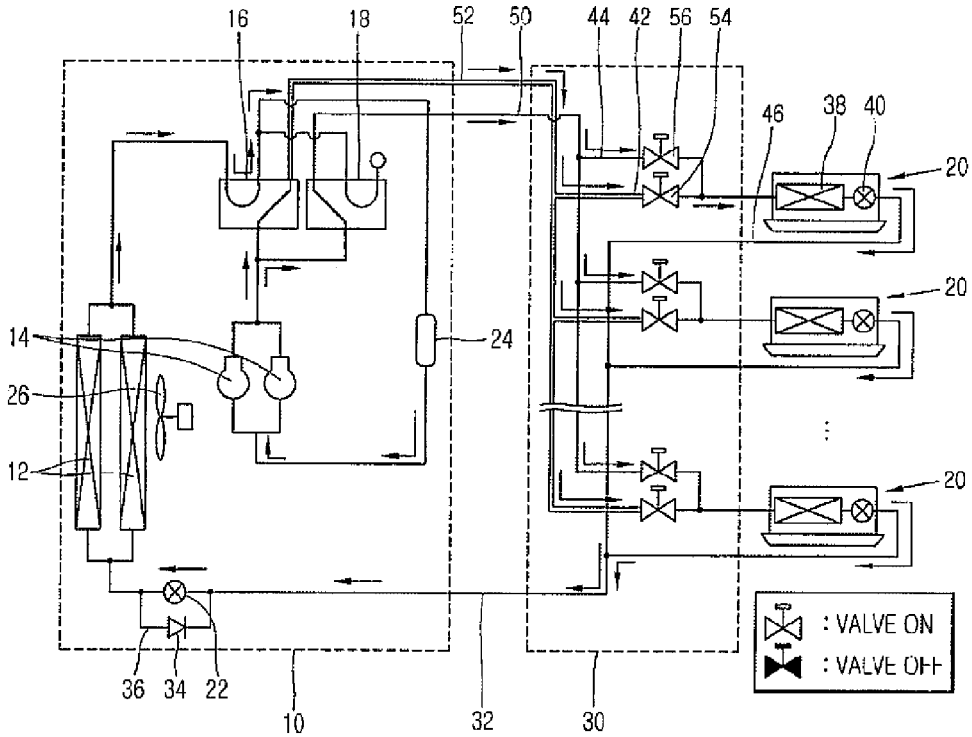
FIGS. 5 to 7 are construction views that illustrate an operational states of the multi type air conditioner in accordance with the present invention.

If all of the indoor units 20 are operated for heating only, as shown in FIG. 5, the control unit 60 turns ON all of the first two-way valves 54 installed at the first distribution pipes 42 connected to the indoor units 20 and all of the second valves 56 installed at the second distribution pipes 44, thereby opening all of the high pressure pipes 52 and the low pressure pipes 50.

Also, the control unit 60 controls the first four-way valve 16 to thereby connect the discharge side of the compressors 14 with the low pressure pipe 50 and to connect the outdoor heat exchanger 12 with the intake side of the compressors 14. Also, the control unit 60 controls the second four-way valve 18 to thereby connect the discharge side of the compressors 14 with the high pressure pipe 52.

If the compressors 14 are driven in such a state, the refrigerant compressed in the compressors 14 are supplied to each indoor unit 20 through the low pressure pipe 50 and the high pressure pipe 52, and the refrigerant supplied to the indoor unit 20 is heat-exchanged with the indoor air to perform the heating operation while passing through the indoor heat exchanger 38. Namely, when all of the indoor units 20 are operated in the heating operation mode, the flow resistance of a refrigerant can be prevented because the refrigerant compressed in the compressors 14 flows to the indoor units 20 through the low pressure pipe 50 having a large diameter and the high pressure pipe 52 having a middle diameter.

The refrigerant discharged from the indoor heat exchanger 38 flows to the outdoor unit 10 along the refrigerant pipe 32. The refrigerant having flowed to the outdoor unit 10 is decompressed and expanded while passing through the outdoor expansion valve 22. Then, the refrigerant is introduced to the outdoor heat exchanger 12, is heat-exchanged with the outdoor air, and then is introduced to the compressors 14 via the first four-way valve 16 to be compressed.

Figure 6:
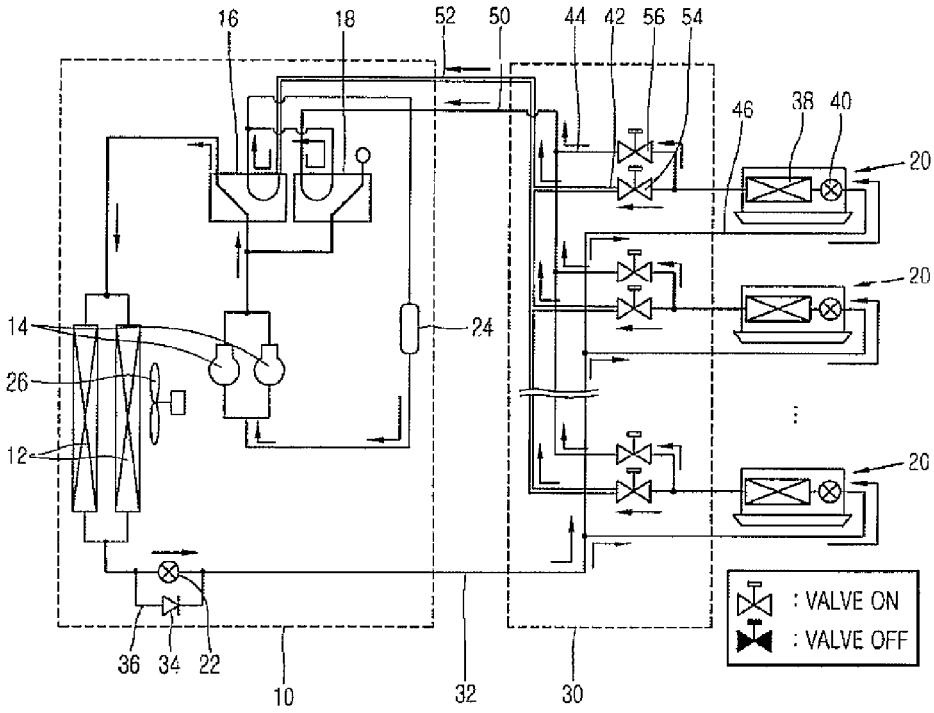

If all of the indoor units 20 are operated for cooling only, as shown in FIG. 6, the control unit 60 turns ON the first valves 54 and the second valves 56 according to a signal transferred from the indoor units 20 to thereby open the low pressure pipe 50 and the high pressure pipe 52.

The control unit 60 controls the first four-way valve 16 to connect the discharge side of the compressors 14 with the outdoor heat exchanger 12 and to connect the low pressure pipe 50 with the intake side of the compressors 14. Also, the control unit 60 controls the second four-way valve 18 to connect the high pressure pipe 52 with the intake side of the compressors 14.

If the compressors 14 are driven in such a state, the refrigerant compressed in the compressors 14 are heat-exchanged with the outdoor air while passing through the outdoor heat exchanger 12, flows along the refrigerant pipe 32, and is supplied to each indoor unit 20 by the third distribution pipe 46. Then, the refrigerant supplied to the indoor unit 20 is decompressed and expanded while passing through the indoor expansion valves 40, and is heat-exchanged with the indoor air to perform the cooling operation while passing through the indoor heat exchanger 38. A portion of a refrigerant discharged from the indoor heat exchangers 38 flows along the low pressure pipe 50 and is introduced to the compressors 14 via the first four-way valve 16, and the remaining portion of the refrigerant flows along the high pressure pipe 52 and is introduced to the compressors 14 via the second four-way valve 18.

As mentioned above, because the refrigerant flows along the high pressure pipe 52 when all of the indoor units 20 are operated for cooling only, an accumulation of a refrigerant within the high pressure pipe 52 is prevented, thereby preventing a shortage of a refrigerant and thusly improving cooling performance and cooling efficiency.

Figure 7:
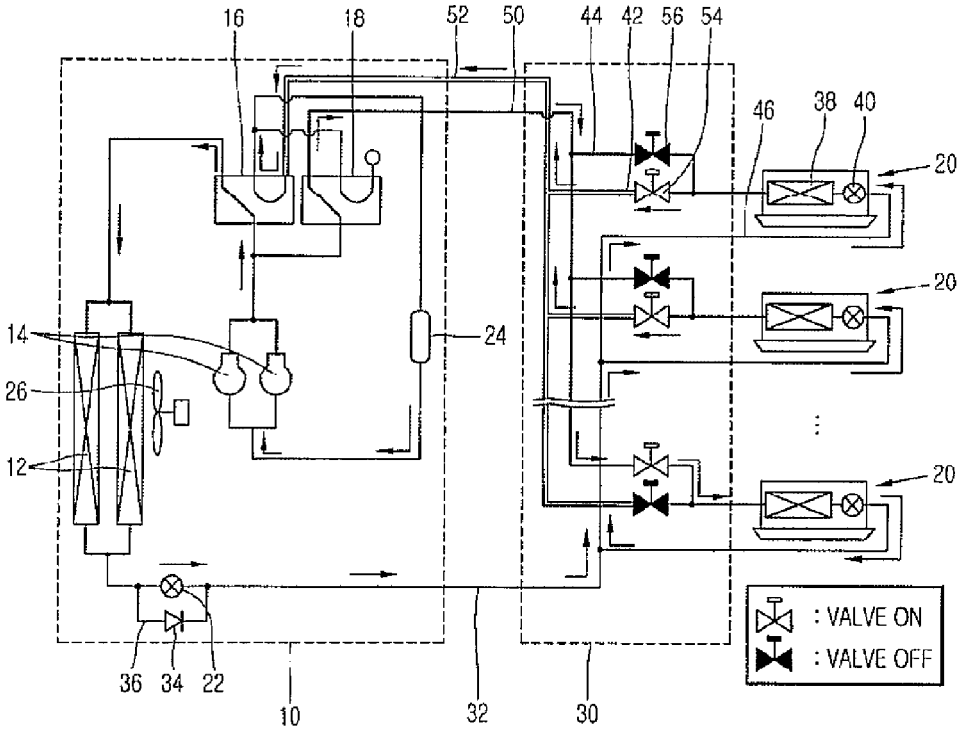

If the number of indoor units 20 operated for cooling is greater than the number of indoor units 20 operated for heating, as shown in FIG. 7, the control units 60 turns OFF the first two-way valve 54 connected to the indoor units 20 being operated for cooling and turns ON the second valve 56 according to a signal transferred from the indoor unit 20. Also, the control units 60 turns ON the first two-way valve 54 connected to the indoor unit 20 operated for heating and turns OFF the second two-way valve 56.

Also, the control unit 60 controls the first four-way valve 16 to connect the discharge side of the compressors 14 with the outdoor heat exchanger 12 and connect the low pressure pipe 50 with the intake side of the compressors 14. Also, the control unit controls the second four-way valve 18 to connect the discharge side of the compressors 14 with the high pressure pipe 52.

If the compressors 14 are driven in such a state, a portion of a refrigerant compressed in the compressors 14 are introduced to the outdoor heat exchanger 12 via the first four-way valve 16, and the remaining refrigerant flows along the high pressure pipe 52 via the second four-way valve 18 to be supplied to the indoor unit 20 operated for heating.

The refrigerant introduced to the outdoor heat exchanger 12 is heat-exchanged with the outdoor air, flows along the refrigerant pipe 32 and is supplied, to each indoor unit 20 operated for cooling by the third distribution pipe 46. Then, the refrigerant supplied to the indoor unit 20 is decompressed and expanded while passing through the indoor expansion valve 40, and is heat-exchanged with the indoor air while passing through the indoor heat exchanger 38, thereby performing the cooling operation. The refrigerant discharged from the indoor heat exchanger 38 flows along the low pressure pipe 50 and is introduced to the compressors 14 via the first four-way valve 16.

The refrigerant introduced to the indoor unit 20 operated for heating is heat exchanged with the indoor air while passing through the indoor heat exchanger 38, thereby performing the heating operation. Then, the refrigerant is supplied along the refrigerant pipe 32 to the indoor units 20 operated for cooling.

In the multi type air conditioner constructed in the aforementioned manner according to the present invention, because the outdoor unit includes the first four-way valve and the second four-way valve, when all of the indoor units are in a heating operation mode, a refrigerant compressed in the compressors are supplied to the indoor units through the low pressure pipe having a large diameter and the high pressure pipe having a middle diameter. Accordingly, flow resistance of the refrigerant is prevented, and the heating performance and the heating efficiency can be improved.

Also, because the outdoor unit includes the first four-way valve and the second four-valve, when all of the indoor units are operated in a cooling operation mode, the refrigerant discharged from the indoor unit flows to the outdoor unit through the high pressure pipe and the low pressure pipe. Accordingly, the refrigerant is prevented from staying in the high pressure pipe, thereby improving the cooling performance and the cooling efficiency.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A multi type air conditioner comprising:

an outdoor unit including an outdoor heat exchanger that exchanges heat with outdoor air, a compressor that compresses a refrigerant, a first four-way valve that connects an outlet of the compressor to the outdoor heat exchanger, and a second four-way valve disposed at the outlet of the compressor in parallel with the first four-way valve;

indoor units that perform at least one of a cooling operation and a heating operation; and a distributor including a low pressure pipe connected between the first four-way valve and each of the indoor units, a high pressure pipe connected between the second four-way valve and each of the indoor units, and a refrigerant pipe connected between the outer heat-exchanger and each of the indoor units, wherein the distributor is connected to the outdoor unit by the low pressure pipe, the high pressure pipe, and the refrigerant pipe.

2. The air conditioner of claim 1, wherein the first four-way valve is connected to the outlet and an inlet of the compressor, the low pressure pipe and the outdoor heat exchanger so as to selectively switch a refrigerant flow path.

3. The air conditioner of claim 1, wherein the second four-way valve is connected to the outlet and an inlet of the compressor and the high pressure pipe so as to selectively switch the refrigerant flow path.

4. The air conditioner of claim 1, wherein the low pressure pipe is connected to each indoor unit by a first distribution pipe, wherein a first two-way valve is installed at the first distribution pipe, the high pressure pipe is connected to each indoor unit by a second distribution pipe, and a second two-way valve is installed at the second distribution pipe.

5. The air conditioner of claim 4, further comprising:

a control unit controlling the first four-way valve and the second four-way valve according to an operation mode of the indoor units and turning ON/OFF the first two-way valve and the second two-way valve.

* * * * *